US006910419B2

(12) United States Patent
Oleson

(10) Patent No.: US 6,910,419 B2
(45) Date of Patent: Jun. 28, 2005

(54) MULTI-USE PALLET WITH TORSION CONTROL FOR A PRINTING MACHINE

(75) Inventor: Andrew L. Oleson, Carol Stream, IL (US)

(73) Assignee: M&R Printing Equipment, Inc., Glen Ellyn, IL (US)

( * ) Notice: Subject to any disclaimer, the term of this patent is extended or adjusted under 35 U.S.C. 154(b) by 284 days.

(21) Appl. No.: 10/185,456

(22) Filed: Jun. 28, 2002

(65) Prior Publication Data

US 2004/0000240 A1 Jan. 1, 2004

(51) Int. Cl.[7] ..... B41F 15/18
(52) U.S. Cl. ..... 101/474; 101/126
(58) Field of Search ..... 101/114, 115, 101/126, 407.1, 474; D18/56, 53, 14; 38/102.91, 102.1; 223/71

(56) References Cited

U.S. PATENT DOCUMENTS

| | | | | | |
|---|---|---|---|---|---|
| 2,737,321 | A | | 3/1956 | Hayslip | |
| D252,814 | S | | 9/1979 | Rands | |
| 4,315,461 | A | * | 2/1982 | Harpold | 101/115 |
| 4,819,559 | A | * | 4/1989 | Szarka | 101/474 |
| 4,942,683 | A | | 7/1990 | Lawson | |
| 4,989,508 | A | | 2/1991 | King | |
| 5,309,831 | A | * | 5/1994 | Fuqua et al. | 101/126 |
| 5,383,400 | A | | 1/1995 | Szyszko | |
| 5,581,918 | A | | 12/1996 | Schilling et al. | |
| 5,592,877 | A | | 1/1997 | Szyszko et al. | |
| 5,626,074 | A | * | 5/1997 | Zelko | 101/115 |
| 5,787,805 | A | | 8/1998 | Szyszko et al. | |
| 5,809,877 | A | | 9/1998 | Szyszko et al. | |
| 6,422,139 | B1 | | 7/2002 | DeCruz | |
| 6,477,930 | B1 | | 11/2002 | Sandford | |
| D480,753 | S | * | 10/2003 | Oleson | D18/56 |

* cited by examiner

*Primary Examiner*—Leslie J. Evanisko
(74) *Attorney, Agent, or Firm*—Wallenstein Wagner & Rockey, Ltd.

(57) ABSTRACT

A pallet (10) for use with a screen printing apparatus having arms (12) extending outwardly from the printing machine supports an article against a printing force supplied by the screen printing machine. A base portion (14) of the pallet (10) is attachable to the arm (12) of the printing machine and includes a support structure extending therefrom to stabilize and reduce deflection against the printing force.

30 Claims, 5 Drawing Sheets

MULTI-USE PALLET WITH TORSION CONTROL FOR A PRINTING MACHINE

DESCRIPTION

TECHNICAL FIELD OF THE INVENTION

The present invention relates to screen printing. Particularly, the present invention relates to a pallet having a torsion control system which is used for supporting textiles in conjunction with printing machines.

BACKGROUND OF THE INVENTION

Printed indicia for applying to items of clothing, such as T-shirts, sweatshirts, golf shirts, shorts, hats, and the like, as well as other cloth and paper goods, such as banners, posters, bags, flags, and the like, have become very popular over the last 20 years. Boutiques specializing in printing fanciful and textual indicia—such as slogans, college names, sport team names and logos, licensed characters, and the like—on these various media, are commonly seen in shopping malls across the country. The indicia available at these stores can be pre-printed on a substrate and applied with a heated press by operators at such boutiques to any of the aforementioned items purchased by a consumer or, more commonly, they can be screen printed directly onto the items in mass quantities for later retail sale.

Typically, a screen printing machine has at least one station for each color employed. For example, a design incorporating two colors will have at least two printing stations, one for each color. A design employing eight colors will have at least eight stations. Each station generally includes a printing head, which supports a single screen, the ink to be used at that particular station and a mechanism for applying the ink to the textile. Each color is carried by a single screen. The textile to be screened travels from printing station to printing station by one of a number of methods, such as a chain or a rigid arm. The textile is usually carried by a metal pallet, pallet support, flat bed, or platen. Common printing machines include turret, oval and linear type machines. In addition to printing stations, there may also be curing stations to heat and set the inks placed on the textile or substrate.

In both the linear and oval style printing machines, the pallet carrying the textile to be printed upon travels via a chain on a track or rail from station to station. In the turret or carrousel style printing machine, a center section has a plurality of spider arms. Generally, there are two levels of spider arms, namely, an upper level carrying the printing heads and screens or the curing assemblies, and a lower level carrying the pallet with the textile to be printed upon. Either the lower pallet/textile arms rotate with respect to the printing/curing arms or the printing/curing arms rotate relative to the pallet/textile arms. The stationary arms are commonly referred to as "stations."

The traveling arm moves from station to station. Specifically, each moving arm is indexed and registered at a station, the station's function, be it printing or curing, is performed and the arm moves to the next station.

For clarity, the discussion following will focus on one configuration, that being moveable lower arms supporting the pallets and textiles and stationary upper arms supporting printing heads or curing units, with the lower arms. It is appreciated this configuration can be different, e.g., stationary printing/curing arms and traveling pallet/textile stations. The teachings of this disclosure work well in any of the configurations.

Highly successful carousel/turret machines are manufactured and sold by M&R PRINTING EQUIPMENT, INC. ("M&R"), Glen Ellyn, Ill. and are sold under the CHAMELEON®, GAUNTLET®, TERMINATOR™, CHALLENGER®, and FORMULA® trademarks.

As to the particulars regarding the screen printing process, a stencil screen is typically blocked (called "masked" in the industry) to embody the desired indicia and is then placed over the item to be printed. Ink of one color is then added to the screen surface and flooded onto the indicia by a flood bar of conventional design. The ink may be of any type well-known in the industry for screen printing. After the ink is flooded onto the screen, the ink is squeegeed through the screen interstices onto the item, leaving ink of the desired color where the interstices in the screen are unblocked. The squeegee can be of any type known in the art. The process may be repeated on each item as many as 16 times using different colors and complementing screens to create just the right design effect. Indexing the screens at each printing station makes this multiple color printing possible.

Placement of these items onto the printing surface of a printing machine can be a critical factor in quality control. Placement of a screened image on, for example, a shirt may typically have only a one-eighth inch tolerance or less in any direction. The tolerance for placement on smaller items may be far less. For this reason, items must be placed with exacting precision onto the printing surface of the printing machine.

Furthermore, it is often desirable to apply ink to the arms of a shirt or the legs of a pair of pants or shorts. It is also often desirable to apply ink to only a portion of the garment. Doing so often requires the use of special pallets for supporting the garments. The special pallets have different widths to accommodate the different widths of the garment legs or sleeves to be printed upon. In particular, to print on a sleeve, the pallet, or a portion of the pallet, is inserted into the sleeve opening with the portion to be printed upon facing the ink carrying screen. Similarly, with pants, the pallet or pallet portion is inserted into the leg opening with the portion to be printed upon facing the screen. Because the widths for the legs differ from the widths of sleeves, specific pallets must be used, depending on the job. For example, pallets for supporting pants must be replaced on a machine with pallets for supporting shirts if there is a job changeover on the machine from printing on the leg of a pair of pants to a sleeve of a shirt.

In addition to the above issues associated with the need and constant changing of pallets, there is a particular problem associated with pallets used to print on pant legs and shirt sleeves. When the squeegee applies a downward force on only a portion of the garment, the pallet on which the garment is resting can, and often does, deflect or exhibit a torsion. Specifically, if the totality of the force applied to the textile and pallet is not directly on the imaginary centerline of the pallet (i.e., the imaginary line passing through the center of the carousel, spider arm and pallet), the pallet may deflect or bend slightly towards and away from the printing head. A twisting or torsion occurs due to the countering forces created by the moment of inertia. Regrettably, even the slightest deflection of the pallet relative to the printing head can have a deleterious effect on the final printed product in that the ink being applied may be uneven and/or poorly applied or the image applied may not be in the exact desired location. In short, any deflection during printing by the pallet carrying the textile can affect the quality of the printing thereon.

SUMMARY OF THE INVENTION

In accordance with the present invention, new multi-use pallets for supporting textiles against a printing force supplied by the screen printing machine are provided. The pallets allow for printing on textiles, such as garment arms or legs, wherein the printing forces are applied off-center and/or along peripheral edges of the pallets while limiting deflection of the pallet. The pallets generally include base portions attachable to the printing machine. The base portions include an upper surface for supporting the articles.

Generally, a pallet is described for use with an arm of a screen printing machine and for supporting an article thereon. The pallet includes multiple legs for permitting different garments or textiles to be supported thereinaround. The base is removably attachable at a first location to the arm and has an imaginary centerline collinear with the arm. Force transferring means are provided interconnecting the base and the arm at a second location spaced from the first location for transferring at least some of a printing force applied to the base by the printing head during the printing process to the second location and for suppressing at least some of the deflection of the base relative to the printing head. The force transferring means includes a sub-pallet fixedly attached to a bottom surface of the base portion, a pair of elongated arms extending outwardly from the sub-pallet towards a center of the printing machine, and a stabilizing bar having opposing ends joined to the pair of elongated arms and having a contacting surface in communication with an external surface associated with the arm. The stabilizing bar is joined to the elongated arms by a coupling which is adjustable to vary the relative distance between the contacting surface and the elongated arms.

In particular, according to one aspect of the invention, the pallet has a support structure. This support structure extends from the base portion to provide a stabilizing force against the printing force supplied by the screen printing machine. The stabilizing force suppresses deflection of the pallet relative to the printing machine and more particularly relative to the screen. As a result, the deflection of the pallet during printing is greatly reduced and/or eliminated entirely.

The base portion comprises a proximal end, a distal end, and a plurality of pallet beams extending outwardly from the proximate end of the pallet towards the machine's turret. The pallet beams are substantially parallel to one another and spaced apart. Thus, each pallet beam has a fixed end at the proximal end of the base portion and a free end at the distal end of the base portion. This allows articles of varying widths to be printed on one pallet. Accordingly, the previously noted need to switch pallets with print jobs is greatly reduced and/or eliminated.

These and other aspects of the present invention set forth in the appended claims may be realized in accordance with the following disclosure with particular reference to the accompanying drawings.

DESCRIPTION OF THE DRAWINGS

To understand the present invention, it will now be described by way of example, with reference to the accompanying drawings in which.

DETAILED DESCRIPTION OF PREFERRED EMBODIMENT

While the invention is susceptible of embodiment in many different forms, this disclosure describes, in detail, preferred embodiments of the invention with the understanding that the present disclosure is to be considered as an exemplification of the principles of the invention and is not intended to limit the broad aspects of the invention to the embodiments illustrated.

Referring generally to the appended FIGS. 1–7, a multi-use pallet 10 for use with a screen printing machine is illustrated. The pallet 10 supports an article, such as a textile, during the printing process. The pallet 10 further supports the textiles against a printing force supplied by the screen printing machine. The articles typically printed upon with the pallets shown are typically garments or textiles, but it should be understood that an article may be anything on which it would be desirable to apply printed indicia. The pallet 10 of the present invention exhibits excellent torsion control and allows garments of varying widths to be printed on a single pallet. Thus, the frequency with which pallets must be changed on the printing machine is greatly reduced while printing quality is maintained.

Figure 1:
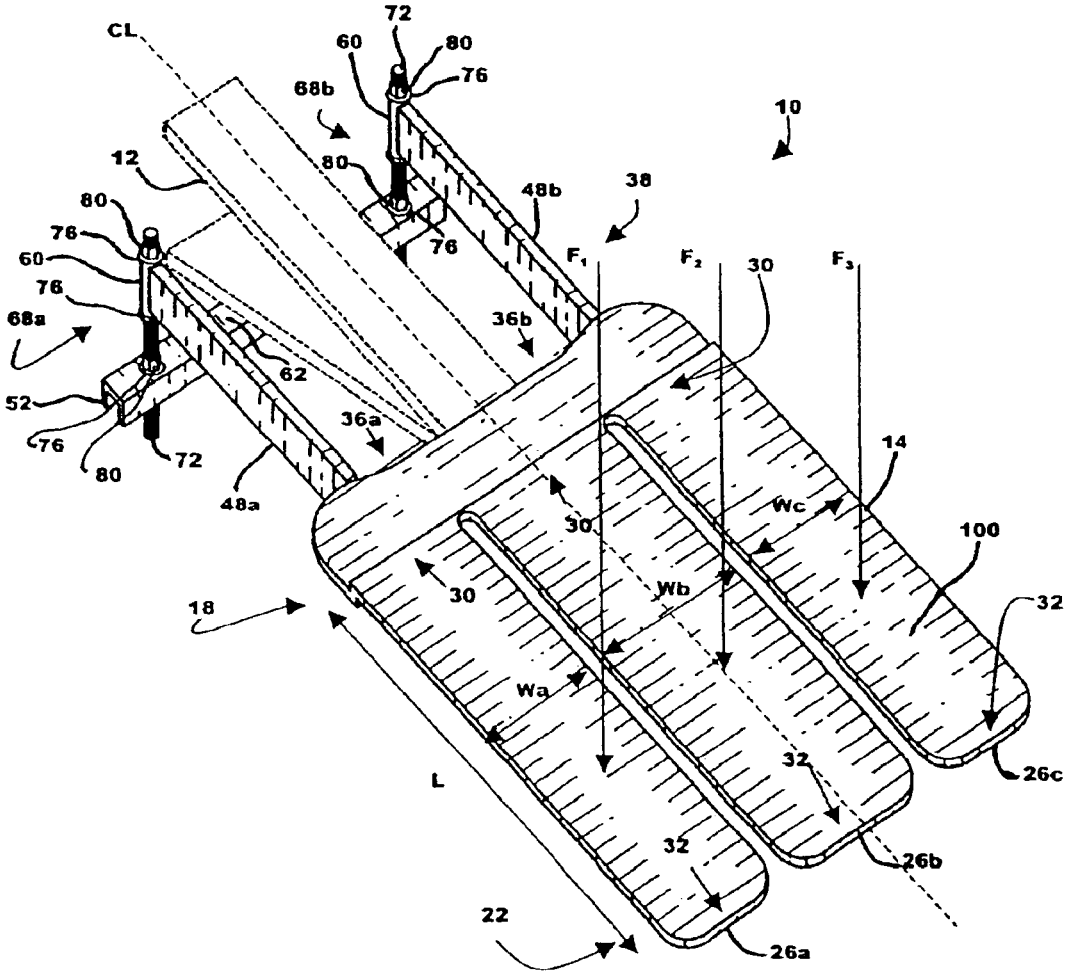
FIG. 1 is a perspective view of a pallet of the present invention attached to an arm of a printing machine.
Figure 2:
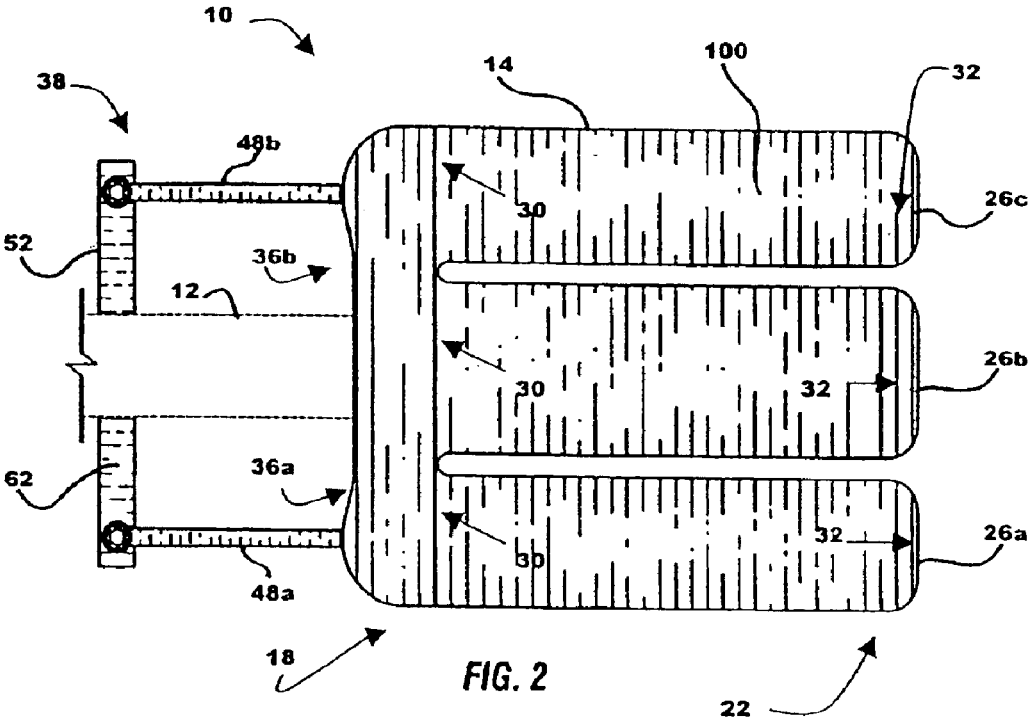
FIG. 2 is top plan view of the pallet of FIG. 1.
Figure 3:
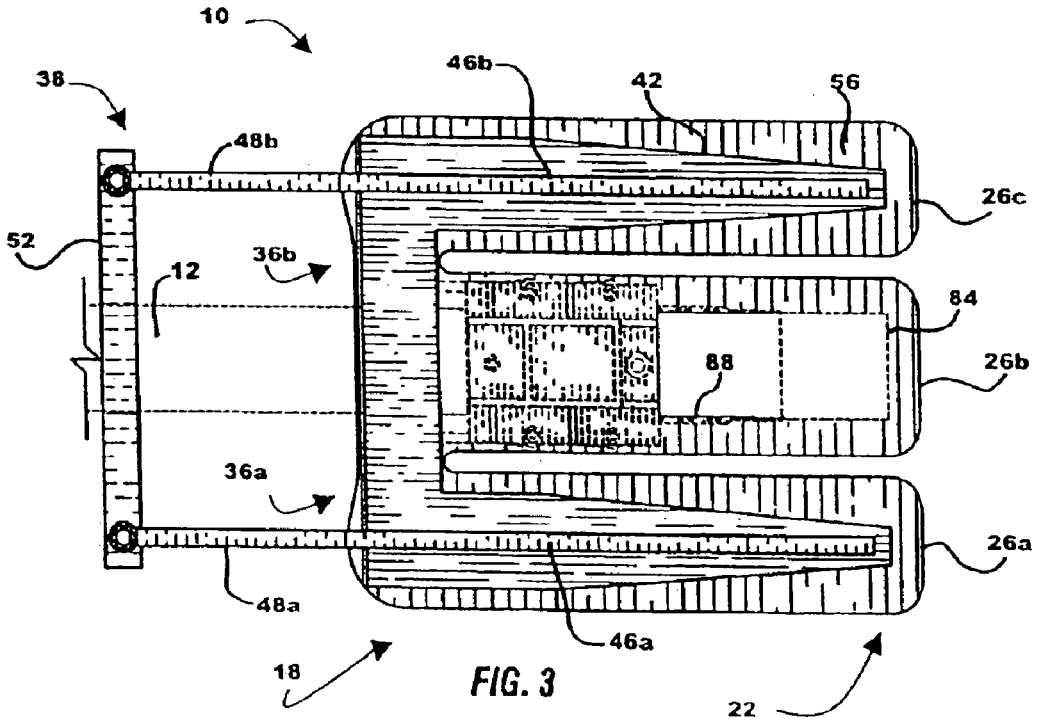
FIG. 3 is a bottom plan view of the pallet of FIG. 1.
Figure 4:
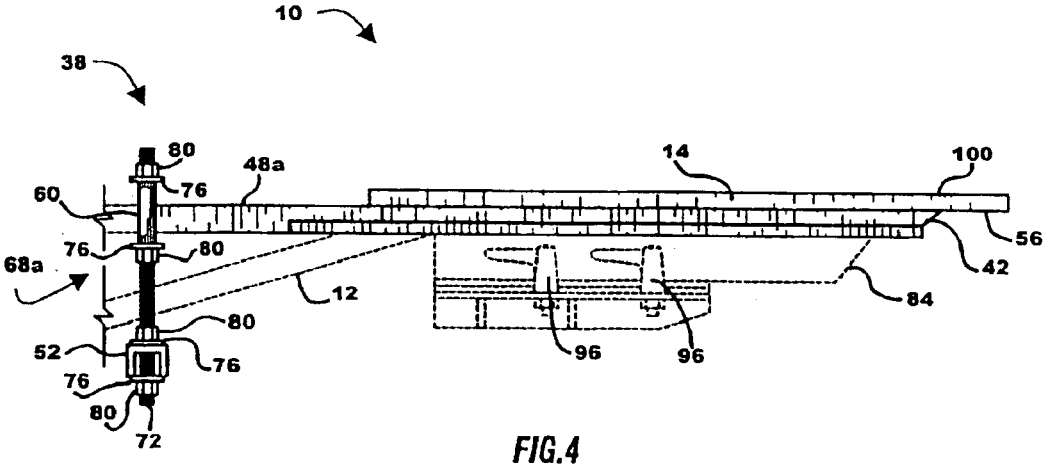
FIG. 4 is a first side elevation view of the pallet of FIG. 1.
Figure 5:
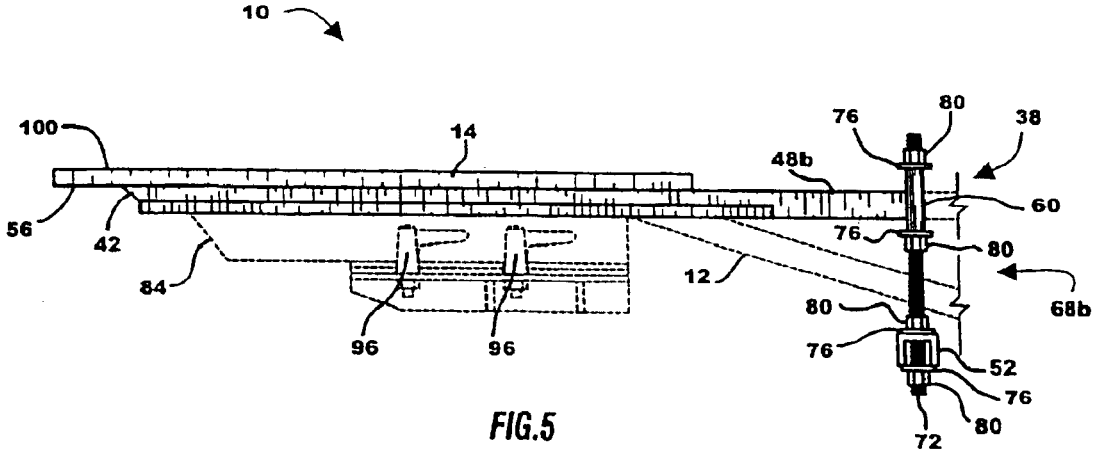
FIG. 5 is an opposing second side elevation view of the pallet of FIG. 1.
Figure 6:
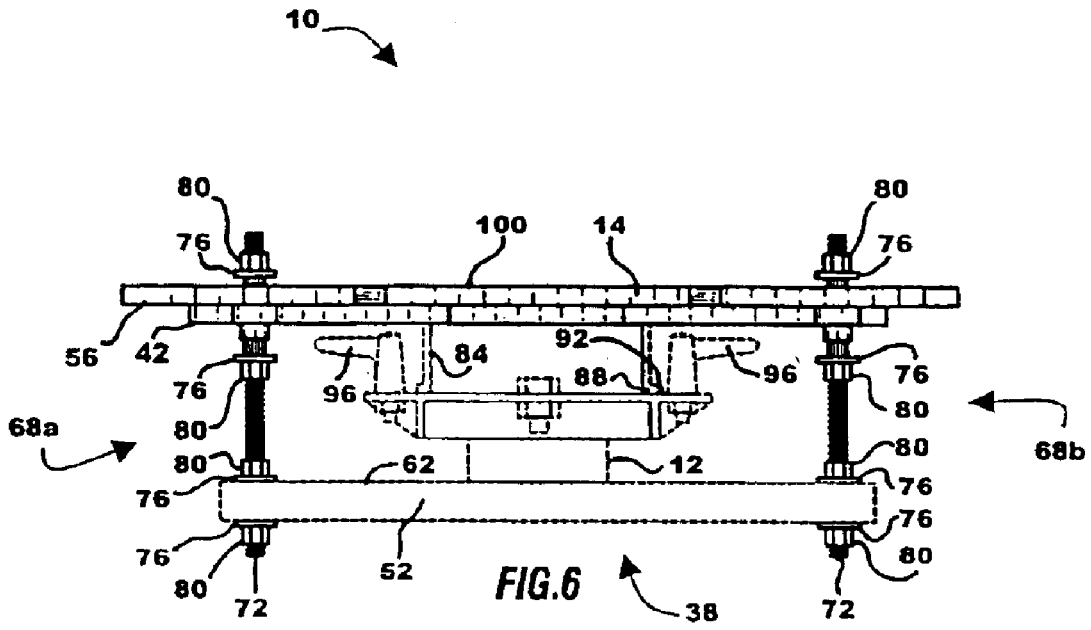
FIG. 6 is front elevation view of the pallet of FIG. 1.
Figure 7:
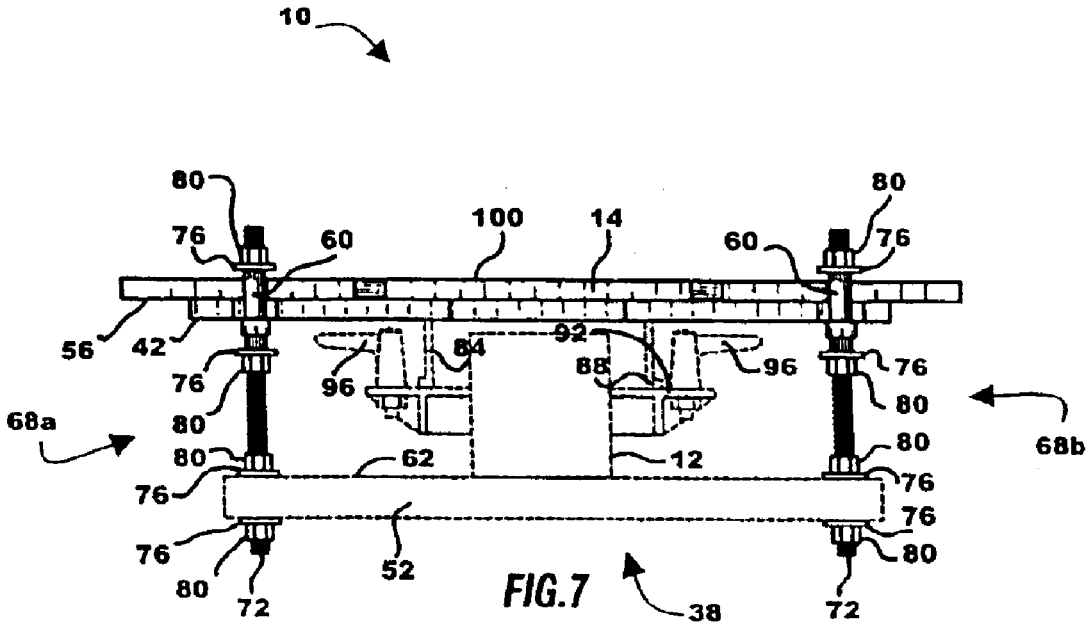
FIG. 7 is a rear elevation view of the pallet of FIG. 1.

Referring to FIG. 1, the pallet 10 of the present invention is attachable to an arm 12 of a printing machine and generally includes a base portion 14. The base portion 14 comprises a proximal end 18, a distal end 22, and a plurality of pallet legs 26*a*,26*b*,26*c*. Preferably, three pallet legs 26*a*,26*b*,26*c* are provided, but any number of pallet legs may be provided without departing from the spirit of the invention. Three pallet legs 26*a*,26*b*,26*c* are preferable to evenly distribute the printing or squeegee force exerted downwardly (F1,F2,F3) on the pallet during printing. If a squeegee blade was cut to print on only one pallet leg (off-set from the centerline CL of the pallet), all the force from the squeegee would be concentrated on that one leg (e.g., force F1 or force F3), a small surface area, which would cause the small area to bend or deflect, and it would place undue amounts of pressure on the single pallet leg area.

The pallet legs 26*a*,26*b*,26*c* are integral with and extend outwardly from the proximal end 18 of the base portion 14. Each pallet leg 26*a*,26*b*,26*c* is spaced apart from an adjacent pallet leg 26*a*,26*b*,26*c* at the distal end 22 of the base portion 12. Thus, each pallet leg 26*a*,26*b*,26*c* has a fixed end 30 at the proximal end 18 of the base portion 10 and a free end 32 at the distal end 22 of the base portion 14.

The free ends 32 allow a garment to be inserted over (and around) the pallet leg 26*a*,26*b*,26*c* with the portion of the textile to be printed upon facing upwardly towards the printing screen. Textile bunching is also kept to a minimum by cutaway portions 36*a* and 36*b* located at the proximal end of the base portion 12, which help get material out of the way and keep the printing area on the garments flat. Further, the pallet legs 26*a*,26*b*,26*c* may be provided with various widths to accommodate different sized clothing. This allows garments or portions of garments having various widths or dimensions (e.g., leg widths and sleeve widths) to be supported on a single pallet 10 without having to change pallets. In particular, in the preferred embodiment, the width $W_a$ of the first (outer) leg 26*a* is about 4½", the width $W_b$ of the second (middle) leg 26*b* is about 6", and the width $W_c$ of the third (outer) leg is about 4½" or 3½". The length L of the legs 26*a*,26*b*,26*c* is approximately 17".

The pallet 10 further comprises a support structure 38 for both supporting and holding the pallet to the printing machine arm 12 and for stabilizing the forces applied against the printing force supplied by the printing machine. For example, when the squeegee of the printing machine 12 applies a downward force that is directed off-center (to the right (force F3) or left (force F1) of the centerline CL) to the pallet 10, on a portion of the article (e.g., a sleeve), a peripheral edge of the pallet 10, or an outer pallet leg 26*a* or 26*c*, the pallet 10 has a tendency to torque or deflect about the printing machine arm (the centerline CL). The support structure 38 suppresses, reduces or eliminates the deflection to improve the quality of the printed article.

This support structure 38 includes a sub-pallet 42 (FIG. 3), a pair of support beams 46*a*,46*b*, a pair of elongated arms 48*a*,48*b*, and a tie or stabilizing bar 52 interconnecting the elongated arms 48*a*,48*b*. In short, two spaced apart elongated arms 48*a*,48*b* are connected at one end to the base 14 of the pallet 10 and project towards the printing machine, collinear with the arm 12 of the printing machine supporting the pallet, and at the other to end to a stabilizing bar 52. Each beam has a coupling 68*a*,68*b* to permit one to both connect the stabilizing bar 52 to the elongated arm 48*a*,48*b* and to adjust/move the bar 52 relative to the arm 48*a*,48*b* and to shore up the bar 52 against the machine's arm 12 so they 52, 12 contact or abut one another. In this manner, forces applied to the pallet 10 (the theoretical combination of the forces generally being spaced from the imaginary center line CL) are transferred to the arm 12 of the printing machine, affecting the moment or torsion of the pallet 10 and minimizing bending/deflection of the pallet 10.

The sub-pallet 42 is constructed from a rigid metallic plate fixedly connected to the bottom surface 56 of the base portion 14. While welding is the preferred method of attachment, adhesives, bolts, or any suitable method of joining two objects may also be used to fix the sub-pallet 42 to the base portion 14. The sub-pallet 42 is preferably a C-shaped plate, about ¼" thick, having tapered portions extending along the bottom surface 56 of the outermost pallet legs 26*a*,26*c*, and a center portion extending along the bottom surface 56 of the proximal end 18 of the base portion 14. The support beams 46*a*,46*b* are integral with the elongated arms 48*a*,48*b*. Specifically, the support beams 46*a*,46*b* are fixedly attached to, or optionally integral with, the sub-pallet 42 and extend downwardly relative to the bottom surface 56 of the base portion 14 so that support beams 46*a*,46*b* are perpendicular to the bottom surface 56. The elongated arms 48*a*,48*b* extend outwardly from the proximal end 18 of the base portion 14 (See FIGS. 4 and 5). The elongated arms 48*a*,48*b* terminate at receptors 60 which are, accordingly, spaced from the base portion 14, the purpose of which will become clear upon further description.

The tie bar 52 interconnects elongated arms 48*a*,48*b* and includes a contacting surface 62 which contacts an external surface or object to provide at least a portion of the stabilizing force. Extending the support beams 46*a*,46*b* from the proximal end 18 of the base portion 14 and supporting them with the tie bar 52 redirects the force to the printing machine arm 12 and the amount of deflection of the pallet 10 is dramatically reduced, especially with long, narrow pallets or pallet arms.

The external surface or object abutting the contacting surface 62 is preferably a portion of the printing machine, such as the arm 12 of the machine, or a reinforcement for the arm of the machine; however, the external surface or object can be any stable surface or object other than a portion of the pallet 10, without departing from the spirit of the invention. The tie bar 52 also has holes which are located adjacent to opposing ends of the tie bar 52.

The tie bar 52 is joined to the elongated arms 48*a*,48*b* by couplings 68*a*,68*b*, which are independently adjustable to allow the tie bar 52 to be drawn against or in communication with the external surface or object. This can vary the distance between the contacting surface 62 and the base portion 14 while at the same time used to vary the force between the contacting surface 62 and the external object.

The couplings 68*a*,68*b* generally comprise a combination of bolts 72, washers 76, and nuts 80. The bolts 72 are inserted through the receptors 60 and the holes in the tie bar 52. The washers 76 are used as bearing members between the nuts 80 and the elongated arms 48*a*,48*b* and the tie bar 52. The nuts 80 can be tightened or loosened to draw the contacting surface 62 into communication with the external object, to vary the distance between the contacting surface 62 and base portion 14, and/or to level the tie bar 52. Also, by adjusting the nuts 80, the distal ends 22 of the pallet legs 26*a*,26*b*,26*c* can be raised.

It should be noted that by using this configuration and tie bar 52, the distal end 22 or lip of the pallet 10 actually rises slightly above its normal location. As such, the stabilizing system employed actually biases the pallet 10 towards the printing head. Thus, when the printing head contacts the textile resting on the pallet 10 and exerts a force thereon, the distal end 22 of the pallet 10 moves downwardly to an ideal position for printing, namely, the position where the pallet 10 would be had there been no stabilizing system involved. In short, by using the system disclosed herein, the pallet 10 moves into its ideal position for printing.

Figure 8:
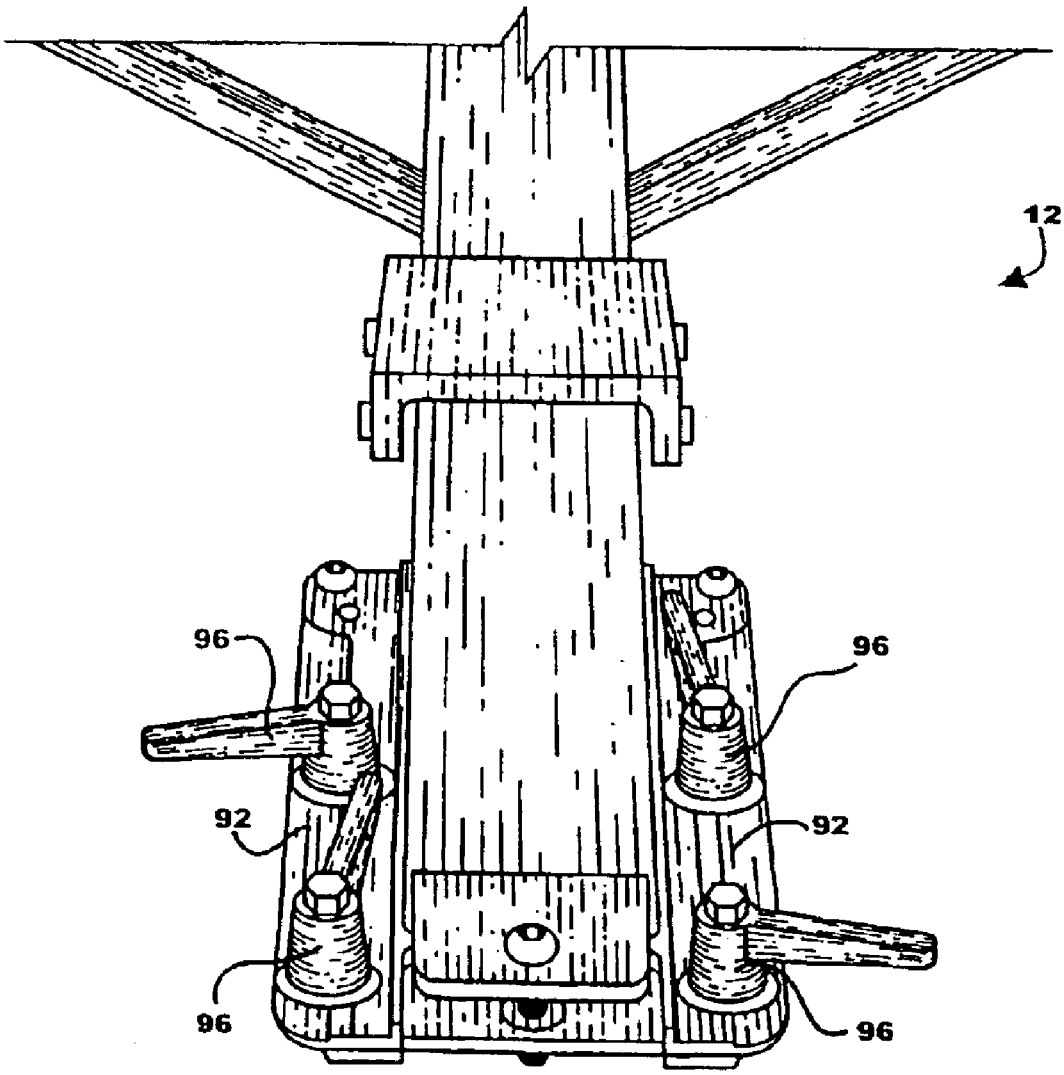
FIG. 8 is perspective view of an arm of a printing machine.

As shown in the drawings, the pallet 10 is attached to the printing machine. Specifically, and with reference to FIG. 3, a bracket 84 is fixedly attached to the bottom surface 56 of the base portion 14. The bracket 84 is typically attached to the bottom surface 56 of the center pallet leg 26*b*. The bracket 84 includes flange portions 88 that extend outwardly along opposing sides of the bracket 84. In use, the printing machine arm 12 (see FIG. 8) is inserted into this bracket 84. The flange portions 88 engage a camming support surface 92, and cams 96 are used to tighten the flange portions 88 against the camming support surface 92 to attach the pallet 10 to the arm 12 of the printing machine.

The pallet 10 of the present invention allows one to print on sleeves, pockets, youth sleeves, shorts, pant legs, etc. The support structure 38, in combination with the pallet leg 26*a*,26*b*,26*c* feature, provides as many stable print surfaces on a top surface 100 of the pallet 10 as is desired. This pallet 10 improves tolerances so that multi-color print jobs on small and odd-shaped articles are made possible.

While specific embodiments have been illustrated and described, numerous modifications are possible without departing from the spirit of the invention, and the scope of protection is only limited by the scope of the accompanying claims.

I claim:

1. A pallet for use with an arm of a screen printing machine and for supporting an article thereon, the arm having an imaginary centerline and a first surface facing a printing head and a second, opposed surface, comprising:

a base removably attachable at a first location to the first surface of the arm; and, force transferring means extending from the base to the second surface of the arm at a second location spaced from the first location adapted for transferring at least some of a printing force applied to the base by the printing head during a printing process to the second location and for suppressing at least some of a deflection of the base relative to the printing head.

2. A pallet for use with an arm of a screen printing machine and for supporting an article thereon comprising:

a base removably attachable at a first location to the arm and having an imaginary centerline collinear with the arm; and, force transferring means extending from the base to the arm at a second location spaced from the first location for transferring at least some of a printing force applied to the base and spaced from the centerline by a printing head of a screen printing machine during a printing process to the second location and for suppressing at least some of a deflection of the base relative to the printing head, the force transferring means including:

a sub-pallet fixedly attached to a bottom surface of the base;

a pair of elongated arms extending outwardly from the sub-pallet towards a center of the printing machine; and, a stabilizing bar having opposing ends joined to the pair of elongated arms and having a contacting surface adapted to be in communication with the printing machine arm.

3. The pallet of claim 2 wherein the stabilizing bar is joined to the elongated arms by a coupling, and the coupling is adjustable to vary a relative distance between the contacting surface and the elongated arms.

4. A pallet for use with a screen printing machine and for supporting an article thereon, comprising:

a base removably attachable to an upper surface of an arm of a printing machine; and, a support structure extending from the base to a surface other than the upper surface of the arm to provide a stabilizing force against a printing force applied to the base by a printing head of the printing machine during a printing process to suppress deflection of the base relative to the arm.

5. The pallet of claim 4 wherein the support structure comprises a contacting surface adapted to be in communication with the printing machine arm for providing at least a portion of the stabilizing force.

6. The pallet of claim 5 wherein the support structure further comprises a sub-pallet fixedly attached to a bottom surface of the base.

7. The pallet of claim 6 wherein the sub-pallet comprises at least one support beam extending downwardly relative to the bottom surface of the base.

8. The pallet of claim 7 wherein the support beam is substantially perpendicular to the bottom surface of the base.

9. The pallet of claim 4 wherein the support structure comprises a pair of elongated arms extending outwardly from the base towards the printing machine.

10. The pallet of claim 9 wherein the support structure further comprises a tie bar having opposing ends joined to the pair of elongated arms.

11. The pallet of claim 10 wherein the support structure further comprises a contacting surface adapted to be in communication with the printing machine arm for providing at least a portion of the stabilizing force.

12. The pallet of claim 11 wherein the contacting surface is located on the tie bar.

13. The pallet of claim 11 wherein the tie bar is joined to at least one of the elongated arms by a coupling.

14. The pallet of claim 13 wherein the coupling is adjustable to vary a relative distance between the contacting surface and the elongated arms.

15. The pallet of claim 4 wherein the base comprises a proximal end, a distal end, and a plurality of pallet legs extending outwardly from the proximal end.

16. The pallet of claim 15 wherein each pallet leg is spaced from an adjacent pallet leg at the distal end of the base wherein each pallet leg has a fixed end at the proximal end of the base and a free end at the distal end of the base.

17. The pallet of claim 16 wherein the fixed end on each pallet leg is integral with the proximal end of the base.

18. The pallet of claim 17 wherein each pallet leg has a width that is not equal to a width of an adjacent pallet leg.

19. A pallet for use with a screen printing machine supporting an article against a printing force supplied by the screen printing machine, the pallet comprising:

a base adapted to be attached on a surface of an arm of the printing machine, the surface being oriented such that the surface faces the supplied printing force, the base comprising a proximal end, a distal end, and a plurality of pallet legs extending outwardly from the proximal end; and, a support structure extending from the base to a surface of the arm other than the surface facing the supplied force for providing a stabilizing force against the printing force to suppress deflection of the pallet relative to the arm.

20. The pallet of claim 19 wherein each pallet leg is spaced from an adjacent pallet leg at the distal end of the base wherein each pallet leg has a fixed end at the proximal end of the base portion and a free end at the distal end of the base portion.

21. The pallet of claim 20 wherein the fixed end on each pallet leg is integral with the proximal end of the base.

22. The pallet of claim 21 wherein each pallet leg has a width that is not equal to a width of an adjacent pallet leg.

23. The pallet of claim 19 wherein the support structure comprises a contacting surface adapted to be in communication with the printing machine arm for providing at least a portion of the stabilizing force.

24. The pallet of claim 23 wherein the support structure further comprises a sub-pallet fixedly attached to a bottom surface of the base.

25. A pallet for use with a screen printing machine, the pallet for supporting an article against a printing force supplied by the screen printing machine, the pallet comprising:

a base comprising a proximal end, a distal end, and a plurality of pallet legs extending outwardly from the proximal end; and, a support structure having a pair of elongated arms extending outwardly from the base for providing a stabilizing force against a printing force supplied by the screen printing machine to suppress deflection of the pallet relative to the printing machine and having a contacting surface adapted to be in communication with the printing machine arm for providing at least a portion of the stabilizing force.

26. The pallet of claim 25 wherein the support structure further comprises a tie bar having opposing ends joined to the pair of elongated arms.

27. The pallet of claim 26 wherein the contacting surface is located on the tie bar.

28. The pallet of claim 27 wherein the tie bar is joined to at least one of the elongated arms by a coupling.

29. The pallet of claim 28 wherein the coupling is adjustable to vary a relative distance between the contacting surface and a top surface of the base.

30. A pallet for use with a screen printing machine, the pallet for supporting an article against a printing force supplied by the screen printing machine, the pallet comprising:

a base portion attachable to the printing machine, the base portion comprising a proximal end, a distal end, and a plurality of pallet legs integral with and extending outwardly from the proximal end, each pallet leg spaced from an adjacent pallet leg at the distal end of the base portion wherein each pallet leg has a fixed end at the proximal end of the base portion and a free end at the distal end of the base portion, each pallet leg further having a width that is not equal to a width of an adjacent pallet leg; and, a support structure for providing a stabilizing force against the printing force supplied by the screen printing machine to suppress deflection of the pallet relative to the printing machine, the support structure extending from the base portion, the support structure comprising a sub-pallet fixedly attached to a bottom surface of the base portion, the sub-pallet including a support beam extending downwardly from the bottom surface of the base portion, support structure further comprising a pair of elongated arms extending outwardly from the base portion, the pair of elongated arms being interconnected by a tie bar which is joined to the elongated arms by a pair of adjustable couplings, the tie bar having a contacting surface adapted to be in communication with a portion of the printing machine for providing at least a portion of the stabilizing force portion wherein the adjustable couplings are adjustable to vary a distance between the contacting surface and the base portion.

* * * * *